United States Patent [19]

Schröder et al.

[11] 4,411,337

[45] Oct. 25, 1983

[54] GROUP CONTROL FOR ELEVATORS

[75] Inventors: Joris Schröder, Lucerne; Hans Bosshard, Würenlos; Jiri Kiml; Miroslav Kostka, both of Ebikon; Walter Zimmermann, Buochs, all of Switzerland

[73] Assignee: Inventio AG, Hergiswil, Switzerland

[21] Appl. No.: 281,567

[22] Filed: Jul. 9, 1981

Related U.S. Application Data

[63] Continuation-in-part of Ser. No. 210,007, Nov. 24, 1980, Pat. No. 4,355,705.

[30] Foreign Application Priority Data

Dec. 21, 1979 [CH] Switzerland ..... 11396/79

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 4,030,571 | 6/1977 | Kaneko et al. | 187/29 R |
| 4,043,429 | 8/1977 | Hirasawa et al. | 187/29 R |
| 4,081,059 | 3/1978 | Kuzunuki et al. | 187/29 R |
| 4,149,613 | 4/1979 | Yoneda et al. | 187/29 R |

*Primary Examiner*—B. Dobeck
*Assistant Examiner*—W. E. Duncanson, Jr.
*Attorney, Agent, or Firm*—Werner W. Kleeman

[57] ABSTRACT

With this group control the allocation of elevator cabins or cars to existing storey or floor calls should be time-wise optimized and newly arriving storey calls should be immediately allocated. A computer device provided for each elevator computates at each landing or storey, irrespective of whether or not there is present a storey or landing call, from the distance between the storey and the cabin position indicated by a selector, the intermediate cabin stops to be expected within this distance and the momentary cabin load a sum proportional to the time losses of waiting passengers. In this way the cabin load prevailing at the computation time point is corrected such that the expected number of passengers entering and exiting the cabin, derived from the previously ascertained number of entering and exiting passengers, is taken into account for the future intermediate cabin stops. Such loss time sum, also referred to as the servicing cost, is stored in a cost storage or memory provided for each elevator and infed to a comparator. During a cost comparison cycle the servicing costs of all elevators are compared with one another, and in an allocation storage of the elevator with the lowest servicing cost there can be stored an allocation instruction which designates that storey or floor to which there can be optimumly allocated the relevant elevator cabin.

9 Claims, 13 Drawing Figures

GROUP CONTROL FOR ELEVATORS

CROSS REFERENCE TO RELATED CASE

This application is a continuation-in-part application of our commonly assigned, copending United States application Ser. No. 210,007, filed Nov. 24, 1980, now U.S. Pat. No. 4,355,705, granted Oct. 26, 1982.

BACKGROUND OF THE INVENTION

The present invention relates to a new and improved construction of a group control for elevators or the like.

Generally speaking, the group control for elevators or the like according to the invention comprises at least one storey call storage which can be controlled by means of storey call transmitters, cabin call storages correlated to each cabin of the group and which can be controlled by means of cabin call transmitters. Further, there are provided selectors correlated to each elevator of the group which indicate that storey at which the cabin still could stop, and load measuring devices correlated to each cabin as well as a scanner device for each storey which possesses at least one position. Each elevator is provided with a computer device possessing an adder, the computer device forming from at least the distance between a considered storey and the selector position, the number of intermediate stops to be expected within such distances predicated upon existing cabin and allocated storey calls as well as the momentary cabin load a time proportional sum corresponding to the service capability of a cabin of the group with respect to the considered storey. At least one comparison device or comparator is provided by means of which the cabin having the lowest servicing cost corresponding to the smallest previously computated loss time and therefore optimum service capability can be allocated to the considered storey or floor.

With such type control as has been disclosed in U.S. Pat. No. 3,511,342 a call determining device possessing a ring counter brings the storey calls contained in the storey call storage or memory into a sequence in which they can be successively allocated by means of a call distributor to the individual cabins of an elevator group. The call distributor examines all of the cabins at the same time and selects that cabin which possesses an optimum servicing or employment capability for the related call, wherein the servicing capability is expressed by a time-proportional signal dependent upon a number of factors. The call distributor contains a finder, for instance in the form of a further ring counter which possesses the finding or seeking positions corresponding to the storey calls. Upon presence of a call selected by the call determining device the finder is placed into operation starting from the related storey, and the storey is found in steps. Upon coincidence of the finder and cabin position there is stored in a distance register a number corresponding to the spacing between the calls site and the cabin, and there is taken into account whether one is concerned with a travel direction command or a free cabin. The determined number is converted into an analogue signal, corresponding to the time needed by the cabin for the relevant distance. This signal is infed to a summation circuit which determines the servicing capability of the cabin.

During the searching or finding operation up to the cabin there is determined by means of coincidence of the finder position and the storey for which there has been stored the storey call or cabin call, the number of intermediate stops and accumulated in an intermediate stop counter. The counter converts this number into an analogue time signal, which likewise is infed to the summation circuit. In the same manner during the complete finding cycle there is determined the total number of stops and there is infed an appropriate analogue time signal at the end of the finding operation to the summation circuit. In a load determination device there is produced a fourth time signal proportional to the cabin load and likewise fed into the summation circuit.

The output signal of the summation circuit which is formed from the existing four signals is infed to a comparison element. A ramp signal which is generated at the end of the searching or finding operation by a ramp signal generator and which increases with time likewise is infed to the comparison element. Upon coincidence of the signals of a comparison element of a cabin there is accomplished the allocation by storing the selected storey call in a requirement storage correlated to the cabin, and in each case there is strived for the coincidence at the cabin with the smallest time-proportional output signal of the summation circuit and therefore optimum cabin servicing or employment capability.

If the selected storey call is not serviced during a time span controlled by a call time measuring device, then it is extinguished in the requirement storage of the relevant cabin and for the purpose of new allocation is infed to the call determining device and from such to the call distributor.

With the previous group control there are determined for the computation of the time loss of a passenger waiting at the considered storey or floor the time losses caused by the travel time of the cabin and the intermediate stops. The time losses of the travelling guests within the elevator cabin, arising due to stop at such storey, however are only insufficiently taken into account, since the cabin load which no longer exists at the servicing time point owing to possible future entering and exiting passengers and determined at the computation time point are basically incorporated into the time loss computation. With these factors it is only possible with extreme difficulty to optimize the call allocation, because the future arising load changes during progressive approach of the cabin at the considered storey due to the exiting and entering passengers is not determined during the computation during the loss times. Furthermore, it is disadvantageous that the storey calls are only then first allocated when they are infed to the call distributor in accordance with the sequence determined by the call distributor and to be performed according to the computation, so that there can arise delays in the allocation.

SUMMARY OF THE INVENTION

It is a primary object of the present invention to provide a group control for elevators which is not associated with the aforementioned drawbacks and limitations of the prior art proposals.

Another and more specific object of the present invention aims at providing a group control for elevators which is improved upon in relation to those previously described, wherein there is improved upon the optimizing of the allocation of the cabins to the considered storey calls and arriving storey calls are immediately allocated.

Now in order to implement these and still further objects of the invention, which will become more readily apparent as the description proceeds, the group control for elevators as contemplated by the present development is manifested by the features that during the computation of the loss times, referred to hereinafter as the internal servicing costs $K_I$, arising upon stop of the elevator cabin or car at the considered called storey or landing for the passengers or guests in the elevator cabin, there is determined the number of probable passengers which are present in the elevator cabin during such cabin stop by upwardly counting from the momentary load present at the considered time point. In this way there is basically determined for the intermediate stops at storey calls an estimated or approximated number of entering passengers, which can be statistically derived from the number of passengers which in the past entered the elevator cabin. For the intermediate stops at cabin calls there is assumed a number of departing or exiting passengers which is computated from the momentary cabin load divided by the number of cabin calls present for the cabin. Furthermore, during the computation of the loss times prevailing for the passengers waiting at the called storey or landing, hereinafter referred to as the outer or external servicing costs $K_A$, there is additionally taken into account the operating state of the cabin or car and the estimated number of entering passengers. The immediate allocation of the arriving storey calls is attained in that the total servicing costs $K_M=K_I+K_A$ consisting of the inner or internal servicing costs $K_I$ and the outer or external servicing costs $K_A$, of a cabin M is computed for each storey, irrespective of whether or not there is present a storey call. The lowest servicing costs determined by comparison and designating the optimum employment or assignment capability of the elevator cabin are stored in the form of an allocation command, and after a new computation cycle of the same storey based upon a new comparison result there can be allocated a different cabin.

The advantages which can be realized with the invention essentially reside in the fact that due to more exact determination of the total servicing costs there can be accomplished an improved optimization of the allocation of the cabin and storey calls, and the total transport time of all passengers consisting of the travel time and the residence times within and externally of the cabin can be minimized and there can be realized an increased conveying capacity of the elevator group. Furthermore, the prior computation of the momentarily optimum employable cabin for each storey, irrespective whether or not a storey call is present, and storage of the corresponding allocation contributes to avoiding further loss times, since an arriving storey call immediately can be allocated.

A further advantage resides in the fact that after a change of the servicing costs $K_N$, brought about by changing traffic conditions and determined by an immediate new computation and the subsequent cost comparison there can be accomplished a new allocation of the cabin-storey call, and with progressive approach of the cabin at the considered storey there is available more exact data during the servicing cost computation. An additional advantage which can be realized with the invention resides in that the internal servicing costs $K_I$, determined by upward computation, can be used for the proper recognition of the traffic saturation of the elevator group. This saturation is characterized by the fact that the presumable or expected loads of all cabins corresponding to the internal servicing costs $K_I$, when stopping at the considered storey, would exceed a threshold value or limit, so that a storey call present at that location would not be serviced. The inventive group control is conceived such that it does not possess any central section, so that as a further advantage there can be realized reliable functioning and cost savings.

BRIEF DESCRIPTION OF THE DRAWINGS

FIG. 1 is a block circuit diagram of the inventive group control for an elevator group composed of three elevators or the like;

DETAILED DESCRIPTION OF THE PREFERRED EMBODIMENTS

Figure 1:
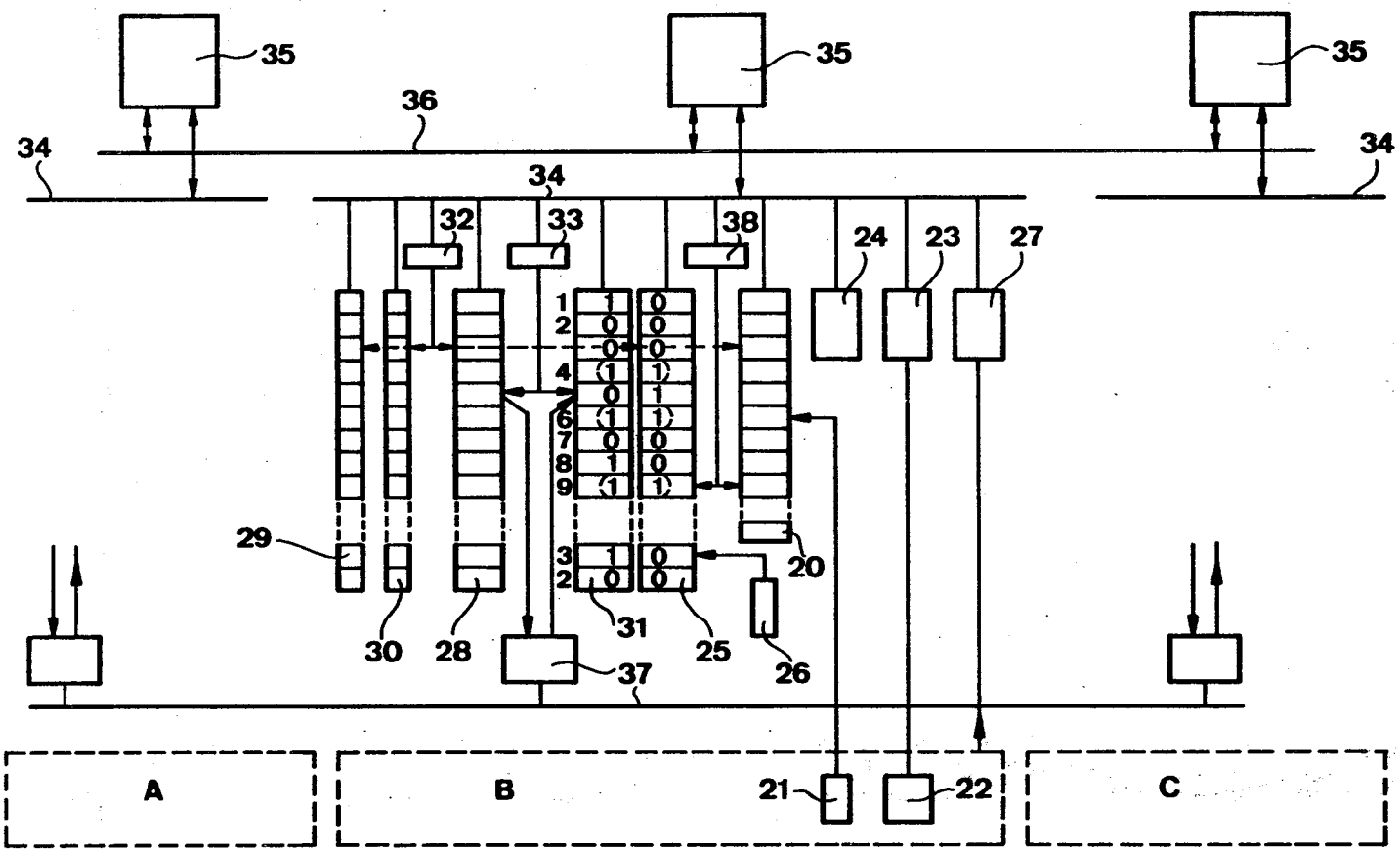

Describing now the drawings, in FIG. 1 reference characters A, B and C designate the elevator cabins of an elevator group composed of the three elevators, wherein each cabin of the group possesses a cabin call storage 20 which can be controlled by means of a cabin call transmitter 21, a load measuring device 22, a load storage 23 operatively connected with the load measuring device and which stores the momentarily cabin load $P_M$, and a device 24 which stores the number $R_C'$ of all cabin calls located in the direction of travel of the cabin. Each elevator of the group has operatively associated therewith a storey call storage or memory 25 which can be controlled by means of the storey call transmitter 26, a device 27 which stores the operating state Z of the momentary cabin, a cost storage or memory 28, two cost portion or constituent storages 29, 30 and an allocation storage 31. The cabin call storage 20, the storey call storage 25, the cost storage 28 and the cost portion storages 29, 30 are connected with a scanner 32. The cost storage 28 additionally is operatively connected with a second scanner 33 connected with the allocation storage 31.

The storages or memories 20, 23, 24, 25 and 27 to 31 are random access memories which are connected by means of an external system bus or bus bar 34 with a microprocessor 35. The microprocessors 35 correlated to the individual elevators of the group are connected with a common line 36 by means of which for instance all of the storey call storages 25 can be connected with one another.

The scanners 32, 33 are storage locations or registers which contain addresses corresponding to the storey numbers, which are newly formed in each case by incrementizing during the scanning of the stories in the upward direction or deincrementizing during scanning in the downward direction. Each storey is provided with two scanner positions, with the exception of the end floors which only each possess one respective scanner position.

In the cost storage 28 there are stored for each position of the first scanner 32 the presumably arising loss times of the passengers, hereinafter referred to as the servicing costs K, as computated by the microprocessor 35. The loss times arising at a future halt at a considered storey for the passengers presumably located in the cabin are designated as the internal servicing costs $K_I$ and the loss times of the passengers presumably waiting at the considered storey and caused by the travel time of the cabin and the intermediate stops, has been designated as the external servicing costs $K_A$. The internal servicing costs determined by the following relationship $$K_I = t_v(P_M + k_1 \cdot R_E - k_2 \cdot R_C)$$

as well as the external servicing costs determined according to the equation $$K_A = k_1[m \cdot t_m + t_v(R_E + R_C - R_{EC} + Z)]$$

are separately stored in the cost portion storages 29, 30. The total servicing costs K stored in the cost storage 28, which constitute a measure for the servicing capability of a cabin N of the group with respect to a real or fictitious storey call of the momentary scanner position n, can be computated according to the following relationship $$K_{N_n} = K_I + K_A = t_v(P_M + k_1 \cdot R_E - k_2 \cdot R_C) + k_1[m \cdot t_m \cdot + t_v(R_E + R_C - R_{EC} + Z)]$$

wherein in the preceding equation the following terms have the following meaning:

- $t_v$ represents the delay time during an intermediate stop,
- $P_M$ the momentary load at the point in time of the computation,
- $R_E$ the number of allocated storey calls between the selector position and scanner position n,
- $R_C$ the number of cabin calls between the selector and scanner position n,
- $k_1$ an expected number of entering persons per storey call determined as a function of the traffic conditions,
- $k_2$ an expected number of exiting persons per cabin call determined as a function of the traffic conditions,
- m the number of storey distances between selector and scanner position n,
- $t_m$ the mean travel time per storey distance,
- $R_{EC}$ the number of coincidences of cabin calls and allocated storey calls between selector and scanner position, and
- Z an addition depending upon the operating state of the cabin.

The expected number of entering individuals $k_1$ per storey is statistically derived from the number of entering passengers in the past, specifically in such a manner that there is determined in each case from the load difference $\Delta L$ stored in the load storage 23 and determined at a storey call during a stop and the load difference $\Delta L'$ of the preceding stop the arithmetic mean, so that $k_1 = \frac{1}{2}(\Delta L + \Delta L')$. The expected number of exiting passengers $k_2$ per cabin call is computed by dividing the momentary cabin load $P_M$ by a number $R_C'$ of all cabin calls located in the direction of travel of the cabin.

In the allocation storage 31 of a cabin there are stored allocation instructions which in each case characterize that storey which is optimumly correlated to the relevant cabin. The storage of an allocation instruction is accomplished always then when the servicing costs K contained in the cost storage 28 of the same cabin are less than those of the remaining elevator cabins. The cost comparison is accomplished during each position of the second scanner 33 by means of a comparison device 37 which is operatively connected with the cost and allocation storages 28, 31 of the relevant cabins A, B, C. As the comparison device or comparator 37 there can be used for instance a device as known in the control which is part of the state of the art and described in the aforementioned U.S. Pat. No. 3,511,342 to which reference may be readily had and the disclosure of which is incorporated herein by reference.

Reference character 38 designates a selector connected with the storey call storage 25 and the cabin call storage 20, which indicates during cabin travel that storey at which the elevator cabin can stop in the presence of a stop or halt command. The selector 38 is a storage location or register containing an address, wherein the address correlated to the stories or floors are formed, depending upon the travel direction, by incrementizing or deincrementizing. A stop command always is then produced in a stop initiation device of a not here further explained drive control which is partially integrated in the previously described microprocessor system, when the selector 38 indicates a storey for which there has been stored a call and the cabin has attained a certain velocity threshold. If until reaching the velocity threshold there has not arrived any call, then the selector 38 is indexed or switched further through one storey.

The input-output components needed for the input of the storey and cabin calls, the load values and the operating state Z of the cabin as well as the external components which signal the momentary operating state Z, such as for instance "opening door", "closing door" or "cabin in travel mode" have not been shown. It should be understood that both the previously mentioned data as well as also the servicing costs and the allocation instructions, as required for digital computation systems, can be processed in the form of multi-bit words of the binary number system. In the embodiment illustrated in FIG. 1 the allocation instructions as well as the storey calls have been symbolically designated by "1", non-present allocation instructions and storey calls accordingly by the symbol "0".

The previously described group control functions in the following manner:

Upon occurrence of an event effecting a certain elevator of the group, such as for instance input of a cabin call, allocation of a storey call or change of the selector position, the first scanner 32 correlated to such elevator begins to revolve, referred to hereinafter as the cost computation cycle KBZ, starting from the selector position in the direction of travel of the cabin. As a result for each scanner position there is accomplished the computation of the servicing costs $$K=t_v(P_M+k_1\cdot R_E-k_2\cdot R_C)+k_1[m\cdot t_n+t_v(R_E+R_C-R_{EC}+Z)].$$

The control program needed for this purpose is stored in a not particularly illustrated but conventional programmable read only memory connected by means of the external system bus bar or bus 34 with the microprocessor 35. After the start of the control program there is accomplished in the microprocessor 35 the counting of the cabin calls $R_C$ located between the storage places (storey calls 3 and 9, FIG. 1) addressed by the first scanner 32 and selector 38 and that storey call $R_E$ for which there are stored allocation instructions (stories 4 and 6, FIG. 1) in the allocation storage 31, as well as the determination of the coincidence $R_{EC}$ of such cabin and storey calls $R_C$, $R_E$. With opposite direction of travel of the scanner 32 and selector 38 there are only counted in each case those cabin calls $R_C$ which are located between the storage place addressed by the selector 38 and the end storey located in the direction of travel. Furthermore, there are counted the storey distances m located between these addresses, wherein with opposite travel direction of the scanner 32 and selector 38 and presence of a direction call the reversal point of the counting direction is the relevant end storey. If no direction call is stored, then the number direction reversal point corresponds to the furthest present cabin call or allocated opposite direction call. Furthermore, there is accomplished the recall of the data $P_M$, $\Delta L$, $\Delta L'$, Z and $R_C'$ from the storages or memories 23, 24, 27 present at the computation time point, computation of the factors $k_1$, $k_2$, and finally, while taking into account the constants $t_v$, $t_m$ stored in the read only memory, the formation of the internal and external servicing costs $K_I$, $K_A$ and their separate storage in the cost portion storages 29, 30 as well as the formation of the entire servicing costs K and storage thereof in the storage place or location of the cost storage 28 addressed by the first scanner 32. When forming the entire servicing costs K with a position of the first scanner 32 indicating a cabin call there are only taken into account the external servicing costs $K_A$, since the time loss of the passengers located in the elevator cabin cannot be ascribed to a storey call present in this considered scanner position, rather would arise anyway. After the storage of the entire servicing costs K there is accomplished formation of the address of the next scanner position and repetition of the previously described operations.

The computation of the servicing costs K is carried out recursively, wherein in each case resort is had to the results of the preceding scanner position and there is only taken into account the changes in the data which have arisen in the meantime.

During a revolution of the second scanner 33 which is accomplished simultaneously at all elevators, hereinafter briefly referred to as the cost comparison cycle KVZ, the servicing costs K contained in the cost storages or memories 28, are infed during each scanning position to the comparison device or comparator 37 and the comparison operation is carried out, wherein in each case there is stored in the allocation storage 31 of that elevator an allocation instruction whose cost storage 28 has the lowest servicing costs K.

If the internal servicing costs $K_I$ contained in the cost proportion storages 29 of all elevators exceeds a certain threshold or limit at a considered scanner position, then there occurs a traffic saturation of the elevator group. This means that a storey call present at such scanner position cannot be serviced, since the threshold value of the inner servicing costs $K_I$ almost corresponds to the expected arising full load condition of the cabins. In this case the storey call is infed to a not here further described waiting list in the form of a storage device or memory from which, following elimination of the saturation while taking into account further there present storey calls such are again recalled in the timewise sequence of their inputting.

Figure 2:
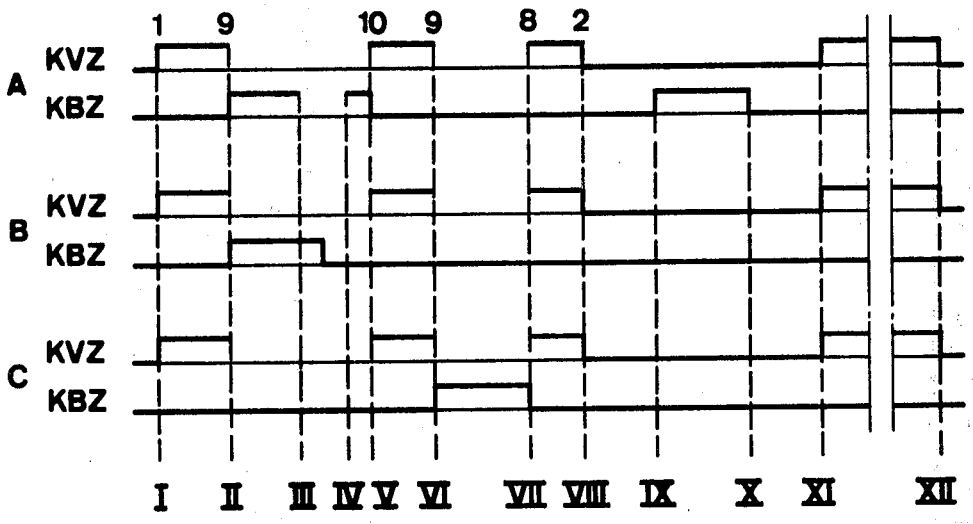
FIG. 2 is a diagram showing the time course of the control.

Based upon the showing of FIG. 2 there will be explained hereinafter the timewise course of the control:

The elevator group consisting in the exemplary embodiment of three elevators is capable of servicing thirteen stories or floors of a building, and thus, has twenty-four scanner positions. At time I the second scanners 33 begin with a cost comparison cycle KVZ in the storey 1 in upward direction, wherein the start is accomplished time-dependent, for instance five to twenty times per second. Based upon the comparison at the scanner position 9 (time point II) there can be accomplished a new allocation by extinguishing an allocation instruction at the elevator A and writing in an instruction at the elevator B. Since according to the example for the storey or landing 9 there is stored a storey call and the selector 38 indicates such storey or floor (FIG. 1), it would be possible to initiate the stop or halt command at the elevator B. Due to this new allocation there will be started for the elevators A, B a respective new cost computation cycle KBZ and the cost comparison cycle KVZ will be interrupted, since the first has priority. During the time that the cost computation cycle KBZ of the elevator B is carried out without any interruption, that of the elevator A might not come into play between the time points III and IV due to a drive interruption. Thereafter the cost comparison is continued starting with the scanner position 10 (time V), in order to again be interrupted (time VI) during the scanner position 9 (downward) upon occurrence of an event at the elevator C, for instance change of the selector position. After completion of thus triggered cost computation cycle KBZ at the elevator C (time VII) there is accomplished continuation of the cost comparison cycle KVZ and its termination at the scanner position 2 (downwards) (time VIII). Between the times, IX and X there occurs a further cost computation cycle KBZ for the elevator A, for instance triggered by a cabin call. The next cost comparison cycle KVZ started at the time XI then proceeds without interruption and is completed at the time XII.

Figure 3:
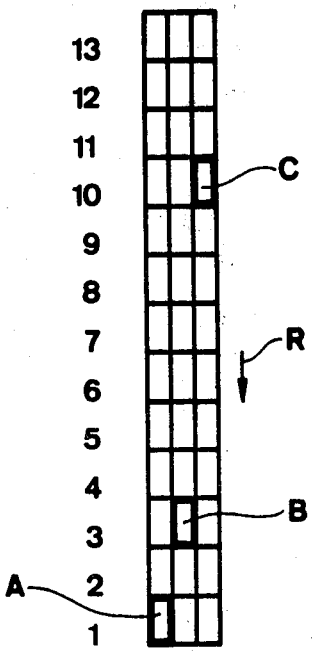
FIGS. 3, 4 and 5 respectively schematically illustrate the elevator group with different allocation examples.

In FIG. 3 there are stationed at the stories or floors 1, 3 and 10 the elevator cabins A, B and C which are stationary. Upon occurrence of a call R at the storey or floor 6 this call is allocated to the cabin B, since in relation to the scanner position corresponding to such call it has the shortest distance, and thus, also the lowest servicing costs K.

Figure 4:
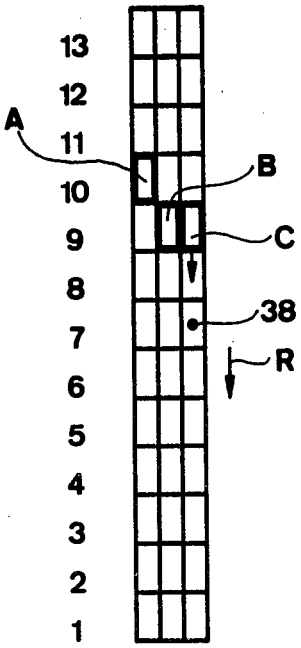

In FIG. 4 the cabins A and B are stationarily located at the stories or floors 10 and 9. The cabin C located likewise at the storey or floor 9 is about to travel downwards, and the selector 38 tends to indicate the storey 7. Upon occurrence of a downward call R at the storey 6 this call is allocated to the elevator cabin C, since the selector position which is decisive for the momentary cabin site in relation to the scanner position corresponding to the call has the lowest servicing costs K.

Figure 5:
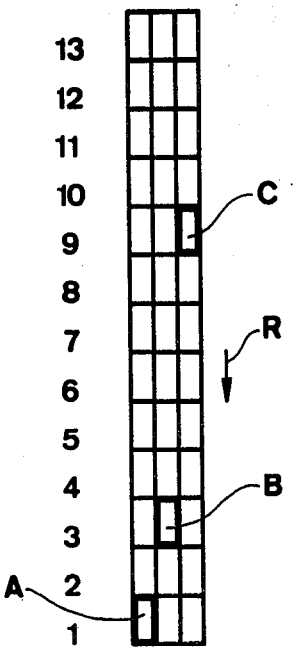

In FIG. 5 the elevator cabins A, B and C which are stationary are stationed at the stories or floors 1, 3 and 9. The elevator cabins B and C have the same servicing costs K in relation to the storey or floor 6. Now if there is inputted at such storey a call R, then this call is allocated to the cabin B, since a priority rule determines that, for instance, in each case the cabin preceeding the marking or characterizing sign has priority.

Instead of the construction proposed according to the exemplary embodiment, it would be possible to realize also with other means the group control of the invention. Thus, for instance, for the computer device there could be employed analogue computer elements, wherein for the storey calls allocated to the number $R_E$ and the devices counting the number $R_C$ of the cabin calls such could be constructed as an operational amplifier connected as a voltage follower, and for the subtractor there could be employed a differential amplifier. The scanner devices 32, 33 and the selector 38 can be mechanical or also electronic stepping mechanisms. The comparison device or comparator 37 can consist of comparators correlated to each elevator and constructed in the form of operational amplifiers functioning as switches, wherein their inputs are connected with the computer device and their outputs with allocation storages, which for each scanner position possess a respective storage cell in the form of a bistable multivibrator.

The inventive group control i.e. control for plural elevators, also can be employed for the horizontal conveying of personnel with an overtaking possibility.

Figure 6:
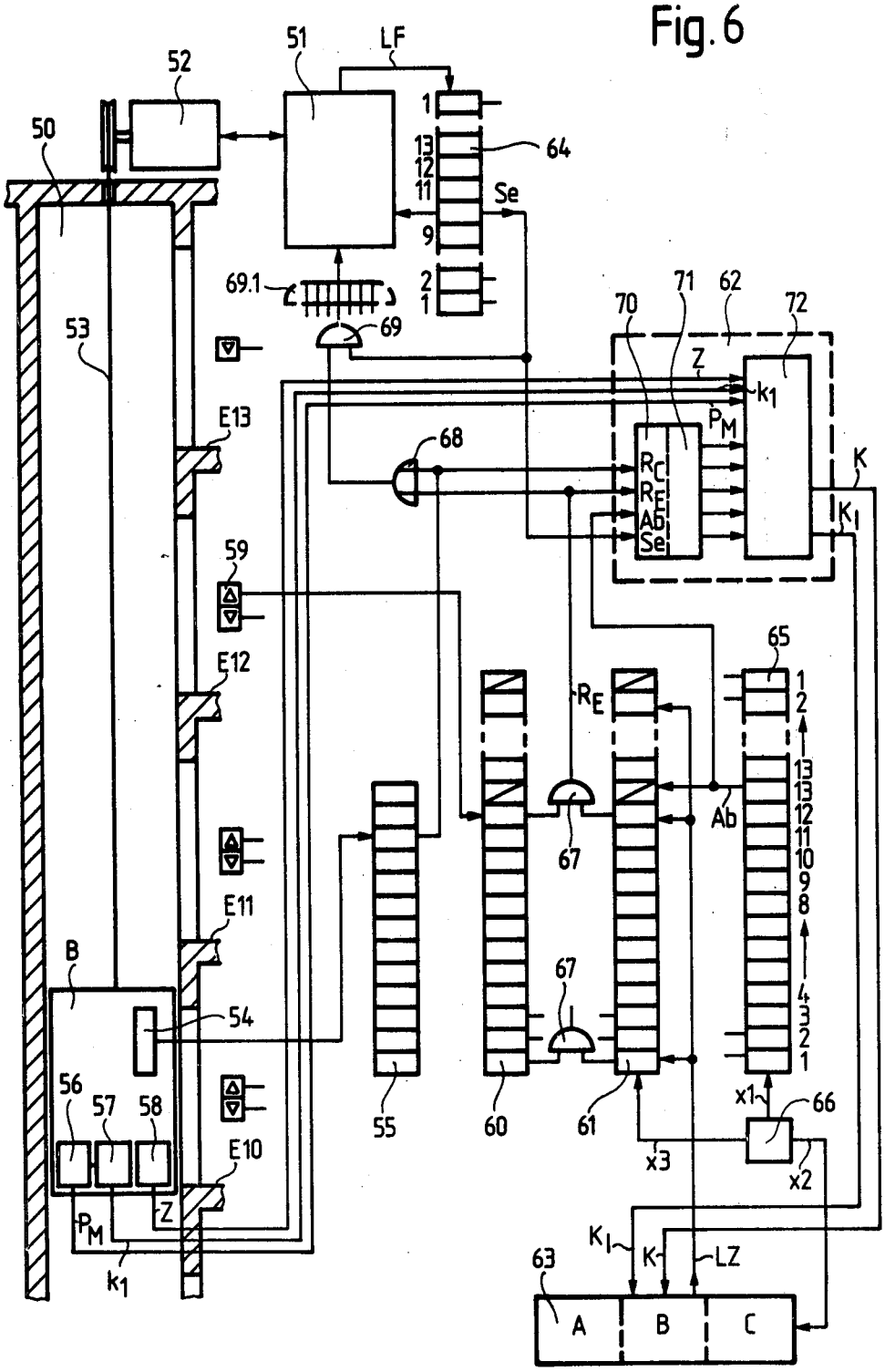
FIG. 6 schematically illustrates a further embodiment of group control for an elevator of an elevator group composed of three elevators.

Continuing, in FIG. 6 reference character 50 designates an elevator shaft or chute of an elevator group composed of, by way of example and not limitation, three elevators. A conveying or drive machine 52, contolled by a drive control 51, drives by means of a conveyor or drive cable 53 a cabin B guided within the elevator shaft 50, and according to the elevator installation selected by way of example there are serviced thirteen stories or floors E1 to E13. To simplify the illustration only the uppermost four stories E10 to E13 have been shown. Each elevator cabin A, B, C of the elevator group has operatively associated therewith a cabin call storage 55 which can be controlled by means of a related cabin call transmitter 54, a load measuring device 56 determining the momentary cabin load $P_M$ in the form of a voltage, a load storage 57 connected with the load measuring device 56 and discussed in greater detail hereinafter, and a device 58 which signals, by means of voltages, the momentary operating state Z of the elevator cabin, such as for instance "open door", "closing door" or "elevator cabin in full travel motion". Each elevator of the group possesses a storey call storage or memory 60 which can be controlled by means of a related storey call transmitter 59, an allocation storage 61, a computer device or computer 62, a comparator 63 and a selector 64. A scanner 65 connected with the inputs of the allocation storage 61 as well as with the inputs Ab of the computer 62, which scanner for instance is constituted by a ring counter controlled by a clock generator 66, possesses, for the selected embodiment entailing servicing of thirteen building stories or floors, thirteen UP-scanner positions and thirteen DOWN-scanner positions. The clock generator 66 is operatively associated with all of the elevators of the group. It thus produces three timewise successive occurring signals x1, x2 and x3. The signal x1 is infed to the scanner 65, the signal x2 to the comparator 63 and the signal x3 to the allocation storage or memory 61.

The cabin call storage 55, the storey call storage 60 as well as the hereinafter detailed described allocation storage 61 possess storage cells preferably composed of flip-flops. At the cabin call storage 55 for each storey and at the storey call storage 60 and at the allocation storage 61 there are provided twenty-four storage cells corresponding to the twelve UP- and twelve DOWN-storey call transmitters 59. The output of the storage cells of the storey call storage 60 and the allocation storage 61 are connected with the inputs of a respective AND-gate 67 provided for each storage cell and possessing two inputs. The outputs of the AND-elements 67, which with set storage cells of the storey call storage 60 and the allocation storage 61 signal an allocated storey call $R_E$, are connected, on the one hand, with inputs $R_E$ of the computer 62 and, on the other hand, in each case with one input of a respective OR-gate 68 which is provided for each storage cell and possesses two inputs. The second inputs of the OR-gates 68 are connected with the outputs of the storage cells of the cabin call storage 55 and the inputs $R_C$ of the computer 62.

The selector 64, for instance constituted by a further ring counter, indicates with the elevator cabin traveling always that storey at which the elevator cabin could still stop in the presence of a stop command. This selector 64, when working with a building having thirteen stories or floors, possesses thirteen UP-outputs and thirteen DOWN-outputs, which in turn are connected, on the one hand, with inputs Se of the computer 62 and, on the other hand, in each case with an input of a respective AND-gate 69 provided for each selector position and possessing two inputs. The selector outputs additionally are connected with the drive control 51. The second inputs of the AND-gates 69 are connected with the outputs of the OR-gate 68. The outputs of the AND-gate 69 are connected with the inputs of an OR-gate 69.1, the output of which is connected with the drive control 51, so that upon coincidence of the selector position and the presence of a cabin call $R_C$ or allocated storey call $R_E$ at the output of the OR-gate or element 69.1 there occurs a stop or halt determination in the form of a logical signal "1" and such is infed to the drive control 51.

The drive control 51, which preferably may be constructed in the manner disclosed in European Pat. No. 0 026,406 possesses a stop initiation device where there is compared a target path correlated to the momentary selector position with a possible target path produced in a reference value transmitter of the drive control 51. Upon identity of the paths and the presence of a stop or halt determination at the output of OR-gate or element 69.1 there is initiated stopping of the elevator. If there is not present any halt or stop determination, then the selector 64 is connected by means of a line LF to the next storey.

The described computer 62, which will now be discussed in detail based upon the illustration of FIGS. 7, 8 and 9, consists of a signal generator 70, a summand generator 71 and a servicing cost computer 72. The inputs $R_C$, $R_E$, Ab and Se of the computer 62 constitute inputs of the signal generator 70, the number of which corresponds to the number of storage cells of the cabin and storey call storages 55, 60 as well as the number of scanner and selector positions Ab, Se. The servicing cost computer 72 is connected at its input side with the output $P_M$ of the load measuring device 56, the output $k_1$ of the load storage 57 and the output Z of the device 58 signalling the momentary operating state of the elevator cabin as well as with the outputs of the summand generator 71.

In the servicing cost computer 72 there is computed, for each position of the scanner 65, apparent arising lost times of the passengers, hereinafter referred to as the servicing cost K. The loss times arising at a future halt at a considered storey for the passengers presumably located in the cabin are again designated as the internal servicing costs $K_I$ and the loss times of the passengers presumably waiting at the considered storey and caused by the travel time of the cabin and the intermediate stops, has again been designated as the external servicing costs $K_A$. The total servicing costs $K=K_I+K_A$, which can constitute a measure of the servicing capability of an elevator cabin N of the group with respect to a real or fictitious storey call of the momentary scanner position n, can be computed in accordance with the following equation:

$$K_{N_n}=t_v(P_M+k_1\cdot R_E-k_2\cdot R_C)+k[m\cdot t_m+t_v\cdot(R_E+R_C-R_{EC}+Z)]$$

wherein in the preceding equation the following terms have the following meaning:

- $t_v$ represents the delay time during an intermediate stop,
- $P_M$ the momentary load at the point in time of the computation,
- $R_E$ the number of allocated storey calls between the selector position and scanner position n,
- $R_C$ the number of cabin calls between the selector and scanner position n,
- $k_1$ an expected number of entering passengers per storey call determined as a function of the traffic conditions,
- $k_2$ an expected number of exiting passengers per cabin call determined as a function of the traffic conditions,
- m the number of storey distances between selector and scanner position n,
- $t_m$ the mean travel time per storage distance,
- $R_{EC}$ the number of coincidences of cabin calls and allocated storey calls between selector and scanner position,
- Z an addition or added term depending upon the operating state of the cabin,
- $t_v(P_M+k_1\cdot R_E-k_2\cdot R_C)$ the internal servicing costs $K_I$ and $k_1\,[m\cdot t_m+t_v(R_E+R_C-R_{EC}+Z)]$ the external servicing costs $K_A$.

The expected number of entering passengers or individuals $k_1$ per storey call is statistically derived from the number of entering passengers in the past, specifically in such a manner that there is determined in each case from the load difference $\Delta L$ stored in the load storage 57 and determined at a storey call during a stop and the load difference $\Delta L'$ of the preceding stop the arithmetic mean, so that $k_1=\frac{1}{2}(\Delta L+\Delta L')$. The expected number of exiting passengers or individuals $k_2$ per cabin call is computed by dividing the momentary cabin load $P_M$ by the number $R_C'$ of all cabin calls located in the direction of travel of the cabin. The total servicing costs K and the internal servicing costs $K_I$ appear in the form of voltages or potentials at the outputs K, $K_I$ of the computer 62.

In the allocation storage 61 of a cabin there are stored allocation instructions which in each case characterize that storey which is optimumly correlated to the relevant cabin. The storage of an allocation instruction is accomplished always then when the servicing costs computed in the servicing cost computer 72 of the same cabin are smaller than that of the remaining elevator cabins. The cost comparison is accomplished during each position of the scanner 65 by means of the hereinafter more fully described comparator 63, which for each cabin is connected at the input side with the outputs K, $K_I$ of the computer 62 and at the output side is connected by means of a line or conductor LZ with the inputs of the storage cells of the allocation storage 61.

Figure 7:
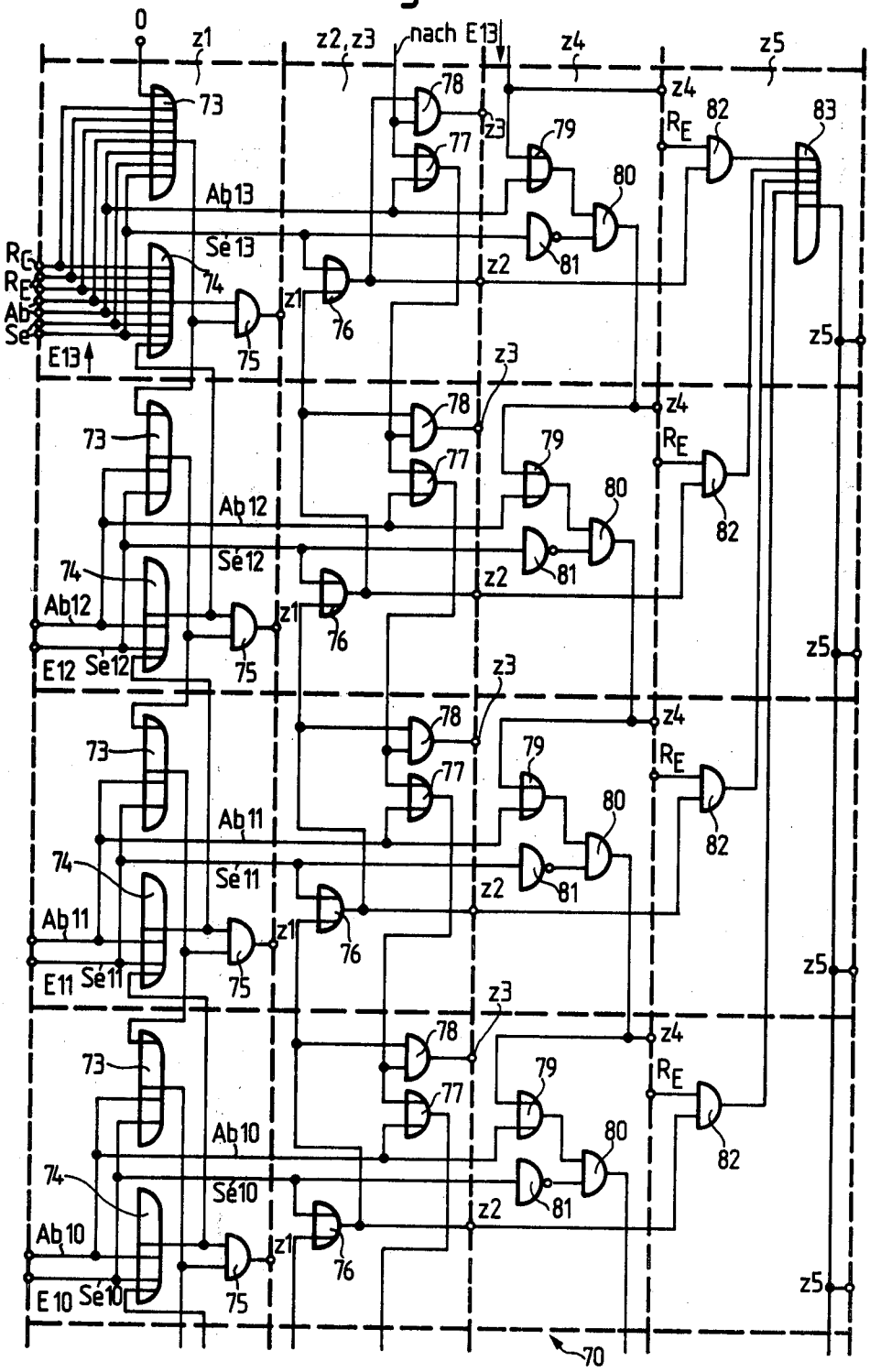
FIG. 7 is a circuit diagram of a signal generator of a computer of the group control illustrated in FIG. 6.

At the signal generator 70 according to FIG. 7 and illustrated for the uppermost four stories or floors E10 to E13, there are produced as a function of the cabin calls $R_C$, the allocated storey calls $R_E$, the scanner position Ab and the selector position Se the signals z1 to z5 needed for the summand generator 71.

Signal z1 is needed for the determination of the number m of storey distances. It assumes the logic state "1" between the selector and scanner positions Se, Ab during the same direction of travel of the selector 64 and the scanner 65. It assumes the logic state "1" between the selector position and the last cabin call $R_C$ or the counter direction call $R_E$ in the travel direction of the cabin, however with the opposite direction of travel of the scanner 65, and thus determines the reversal point of the counting direction for the storey distances m.

The signal z2 is needed for the counting of all cabin calls $R_C'$ between the selector position and the end storey or floor located in the travel direction as well as for generating the signals z3 and z5. It assumes the logic state "1" between the selector position and the end floor or storey located in the travel direction.

The signal z3 is needed for the counting of the cabin calls $R_C$ and the intermediate stops $(R_E+R_C-R_{EC})$. It assumes the logic state "1" between the selector and scanner position in the travel direction of the cabin with the same direction of travel of the scanner 65.

The signal z4 is required for the counting of the storey distances m, the intermediate stops $(R_E+R_C-R_{EC})$ and the allocated storey calls $R_E$. It assumes the logic state "1" between the selector and scanner position in the travel direction of the cabin for the same and opposite travel direction of the scanner 65.

The signal z5 is required for the counting of the storey distances m. It assumes the logic state "1" between the selector position and the terminal or end storey located in the travel direction, upon the presence of a direction call $R_E$ in this region. In this way there is determined the relevant terminal storey or floor as the reversal point of the counting direction.

In order to generate the signal z1 there are provided for each storey two OR-gates or elements 73, 74 each having eight respective inputs and an AND-gate or element 75 having two inputs. The inputs of the OR-gates 73, 74 are operatively correlated with the cabin calls $R_C$, the allocated UP- and DOWN-storey calls $R_E$, the scanner positions Ab and the selector positions Se. The outputs are connected with the inputs of the AND-gate or element 75, at the output of which there appears the signal z1. The OR-gates 73, 74 of all stories are logically coupled with one another, and in each instance an input of the OR-gates 73 or 74, as the case may be, correlated with the terminal storey or floor, is associated with the logic state "0".

To produce the signal z2 there is provided for each selector position Se an OR-gate or element 76 having two inputs. The first input is connected in each case with the selector position Se, whereas the second input is connected with the output of the preceding OR-gate or element 76. The second inputs of the first OR-gates 76 of the UP- and DOWN-travel direction of the selector 64 are associated in each instance with the logic state "0". The signal z2 appears at the output of the OR-gate or element 76.

To produce the signal z3 there are provided for each scanner position Ab an OR-gate or element 77 and an AND-gate or element 78 with in each case two inputs. The first input of the OR-gate 77 is connected with the scanner position Ab, whereas the second input is connected with the output of the OR-gate or element 77 which follows in the scanner direction. The second input of the OR-gate 77 which is correlated with the last scanner position is associated with the logic state "0". The inputs of the AND-gate or element 78 are connected with the output of the OR-gate 76 and the second input of the OR-gate 77. The signal z3 appears at the output of the AND-gate 78.

To produce the signal z4 there are provided for each scanner position Ab an OR-gate 79 and AND-gate 80 which are provided in each case with two inputs as wells as a NOT-gate or element 81. The first input of the AND-gate or element 80 is connected by means of the NOT-gate or element 81 with the selector position Se, whereas the second input is connected with the output of the OR-gate or element 79. Its first input is connected with the scanner position Ab, whereas its second input is connected with the output of the AND-gate 80 which follows in the scanning direction and exhibits the signal z4.

To generate the signal z5 there are provided for each selector position Se an AND-gate for element 82 having two inputs for each travel direction an OR-gate or element 83 having thirteen inputs. The first input of the AND-gate 82 is connected with the signal output z2; its second input is connected with the relevant input of the allocated storey call $R_E$. The output of all of the AND-gates or elements 82 are connected with the inputs of the OR-gate or element 83, the output of which carries the signal z5.

Figure 8:
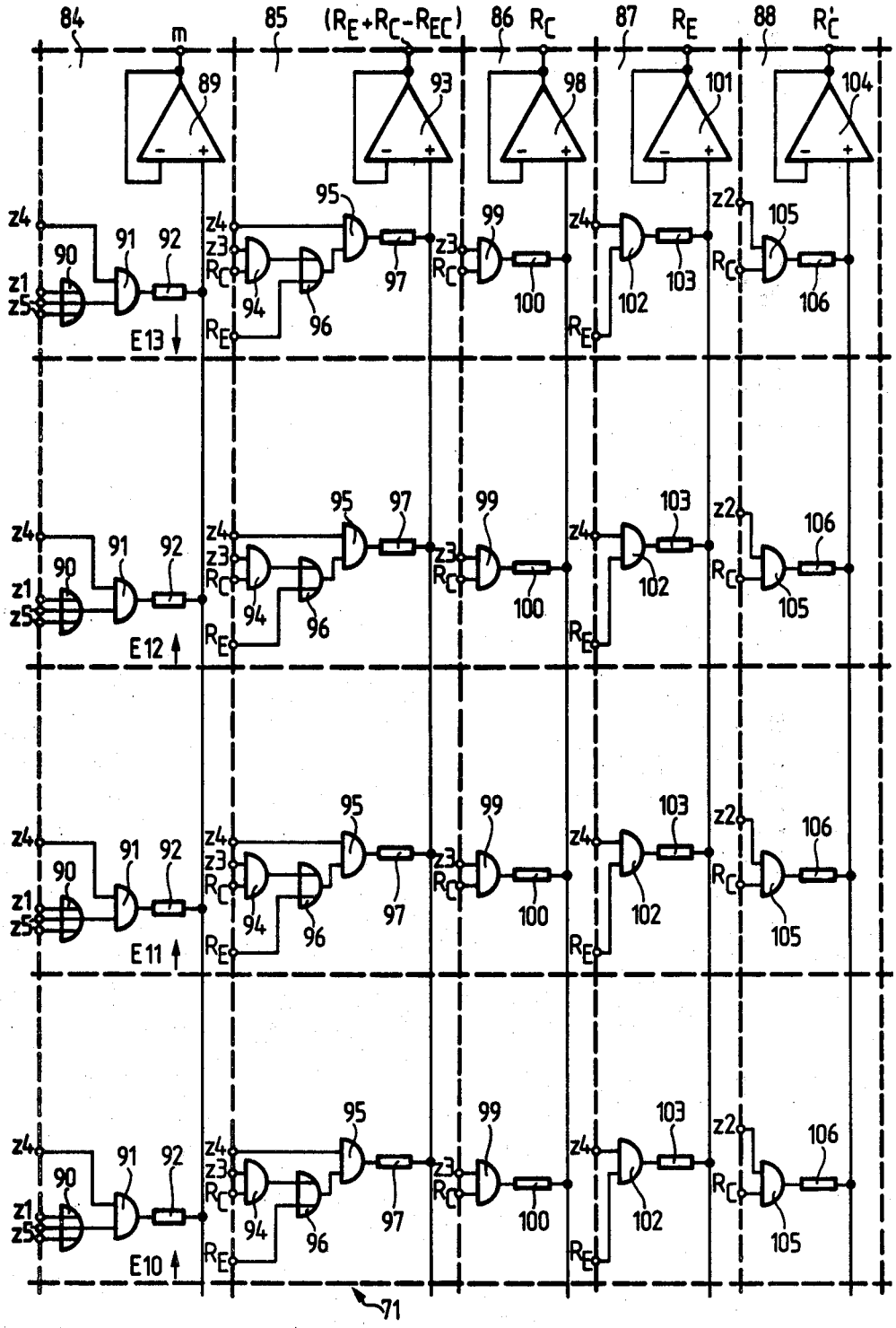
FIG. 8 is a circuit diagram of a summand generator of the computer.

The summand generator 71 of FIG. 8 and illustrated for the uppermost four stories E10 to E13, will be seen to comprise five counters 84, 85, 86, 87 and 88. The first counter or counting device 84 for the number m of the storey distances consists of an adder 89 in the form of an operational amplifier connected as a voltage follower as well as for each storage cell of the storey cell storage 60 of an OR-gate or element 90 having three inputs, an AND-gate or element 91 having two inputs and a resistance 92. The first input of the OR-gate 90 has infed thereto the signal z1, the second input the signal z5 of the UP-travel direction and the third input the signal z5 of the DOWN-travel direction. The output of the OR-gate 90 is connected with the first input of the AND-gate or element 91, the second input of which has infed thereto the signal z4. The output of the AND-gate or element 91 is connected by means of the resistance or resistor 92 at the input of the adder 89, at the output of which there appears the number m of storey distances in the region determined by the signals z1, z4 and z5, in the form of a voltage or potential.

The second counter 85 for the intermediate stops ($R_E+R_C-R_{EC}$) to be expected consists of an adder 93 in the form of an operational amplifier which is connected as a voltage follower as well as for each scanner position of two AND-gates 94, 95 each having two inputs, an OR-gate or element 96 having two inputs and a resistance or resistor 97. The first input of the AND-gate or element 94 has infed thereto the signal z3, whereas the second input has delivered thereto a possibly present cabin call $R_C$. The output of the AND-gate or element 94 is connected with the first input of the OR-gate 96, the second input of which has infed thereto a possibly present allocated storey call $R_E$. The output of the OR-gate 96 is connected with the first input of the AND-gate or element 95, the second input of which has delivered thereto the signal z4 and whose output is connected by means of the resistance 97 with the input of the adder 93. At the output of the adder 93 there appear the intermediate stops ($R_E+R_C-R_{EC}$) which are to be expected at the region determined by the signals z3, z4 in the form of a voltage. The AND-gate 94 thus causes counting but one time of the cabin calls $R_C$ which are located in the travel direction between the selector 64 and the terminal storey or floor with opposite direction of travel of the scanner 65.

The third counter 86 for the cabin call $R_C$ consists of an adder 98 in the form of an operational amplifier connected as a voltage follower as well as for each scanner position of an AND-gate or element 99 having two inputs and a resistance or resistor 100. The first input of the AND-element 99 has connected thereto the signal z3, whereas the second input has delivered thereto a possibly present cabin call $R_C$. The output of the AND-gate or element 99 is connected by means of the resistance 100 with the input of the adder 98, at the output of which there appears the determined number $R_C$ of cabin calls in the region governed by the signal z3, in the form of a voltage or potential.

The fourth counter 87 for the allocated storey calls $R_E$ consists of an adder 101 in the form of an operational amplifier connected as a voltage follower as well as for each scanner position of an AND-gate or element 102 having two inputs and a resistance or resistor 103. The first input of the AND-gate 102 has connected thereto the signal z4, whereas the second input has delivered thereto a possibly present allocated storey call $R_E$. The output of the AND-gate 101 is connected by means of the resistance 103 with the input of the adder 101, at the output of which there appears the determined number $R_E$ of allocated storey calls in the region governed by the signal z4, in the form of a voltage or potential.

The fifth counter 88 for all cabin calls $R_C'$ located in the travel direction of the cabin consists of an adder 104 in the form of an operational amplifier connected as a voltage follower as well as for each selector position of an AND-gate or element 105 having two inputs and a resistance or resistor 106. The first input of the AND-gate 105 has connected thereto the signal z2, whereas the second input has delivered thereto a possibly present cabin call $R_C$. The output of the AND-gate 105 is connected by means of the resistance 106 with the input of the adder 104, at the output of which there appears the determined number $R_C'$ of all cabin calls which are located in the travel direction of the cabin, in the form of a voltage or potential.

Figure 9:
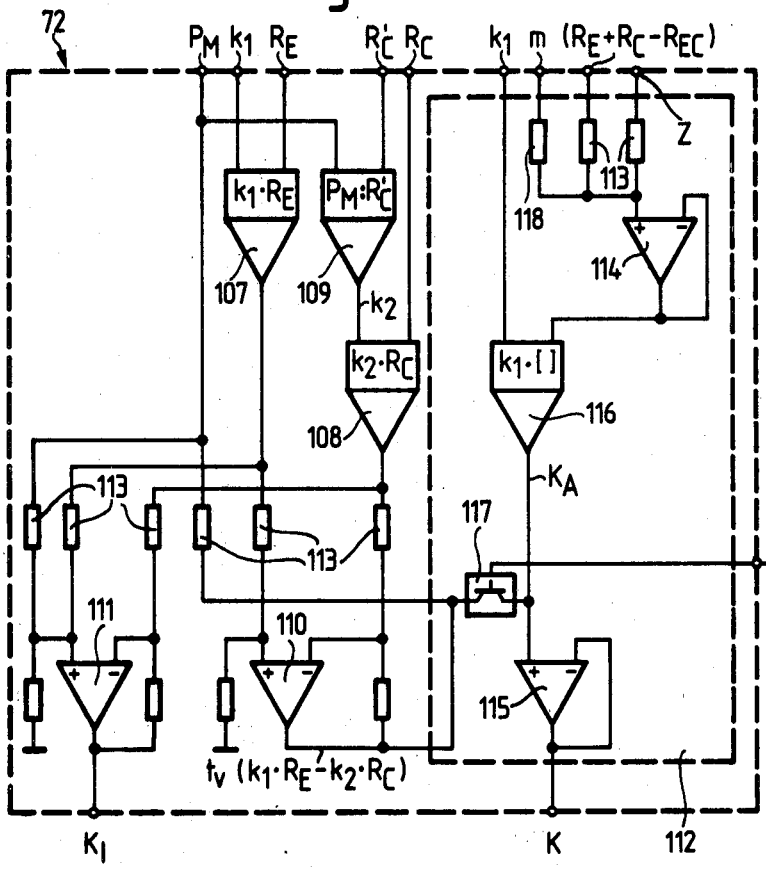
FIG. 9 is a circuit diagram of a servicing cost computer of the computer shown in FIG. 7.

The servicing cost computer 72 according to the embodiment of FIG. 9 consists of two multipliers 107, 108, a divider 109, two subtractors 110, 111 and an adder 112. The multipliers 107, 108 as well as the divider 109 are constructed in conventional manner, for instance, of operational amplifiers. The inputs of the first multiplier 107 have infed thereto the output signal $k_1$ of the load storage 57 and the number $R_E$ of the allocated storey calls. The inputs of the divider 109 have infed thereto the momentary load $P_M$ and the number $R_C'$ of all cabin calls located in the travel direction of the cabin. The output magnitude $k_2$ of the divider 109 as well as the number $R_C$ of the cabin calls between the selector and scanner positions are connected with the inputs of the second multiplier 108. The output of the first multiplier 107 is connected by means of a respective resistance 113 with the non-inverting inputs of both subtractors 110, 111 designed as operational amplifiers. The output of the second multiplier 108 is connected by means of a respective further resistance 113 at the inverting inputs of the subtractors or subtracting units 110, 111. The non-inverting inputs of the one subtractor 112 has additionally infed thereto by means of a further resistance 113 also the momentary cabin load $P_M$ so that at its output there appear the internal servicing costs $K_I=t_v(P_M+k_1\cdot R_E-k_2\cdot R_C)$, wherein the factor $t_v$ is governed by the resistance 113. The output signal of the other subtractor 110 corresponds to the difference $t_v(k_1\cdot R_E-k_2\cdot R_C)$, which is infed to the adder or adding unit 112.

The adder 112 consists of two operational amplifiers 114, 115 connected as voltage followers, a multiplier 116 likewise formed of operational amplifiers and a transistor switch 117. The input of the first voltage follower i.e. operational amplifier 114 has infed thereto by means of a resistance 118 the number m of storey distances and by means of further resistances 113 the intermediate stops $(R_E+R_C-R_{EC})$ to be expected and the output signal Z of the device which signals the momentary operating state of the cabin. The output of the first voltage follower or operational amplifier 114 is connected with an input of the multiplier 116, the other input of which has connected thereto the output signal $k_1$ of the load storage or memory 57, so that there appears at the output of the multiplier 116 the external servicing costs $K_A=k_1[m\cdot t_m+t_v(R_E+R_C-R_{EC}+Z)]$, wherein the factor $t_m$ is governed by the resistance 118 and the factor $t_v$ by the resistance 113. The output of the multiplier 116 is connected with the input of the second voltage follower or operational amplifier 115, which also is connected by means of the transistor switch 117 at the output of the subtractor 110 which produces the difference $t_v(k_1\cdot R_E-k_2\cdot R_C)$. Additionally, there is infed to the input of the second voltage follower or operational amplifier 115, by means of a further resistance 113 and the transistor switch 117, the signal proportional to the momentary cabin load $P_M$, so that there appears at the output of the second voltage follower or operational amplifier 115 the entire servicing costs K.

Figure 10:
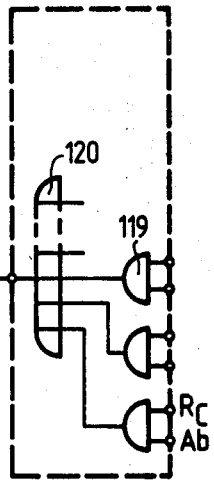
FIG. 10 is a circuit diagram of a coincidence circuit of the servicing cost computer illustrated in FIG. 9.

The illustrated embodiment of coincidence circuit shown in FIG. 10 possesses for each scanner position Ab an AND-gate or element 119 having two inputs and an OR-gate or element 120 having inputs corresponding to the number of scanner positions Ab. The first input of the AND-gate or element 119 is connected in each case with an output Ab of the scanner 65, whereas the second input has delivered thereto a possibly present cabin call $R_C$, which in each instance is allocated both to the AND-gate 119 of the UP-direction and also to the AND-gate 119 of the DOWN-direction. The outputs of the AND-gate 119 are connected with the inputs of the OR-gate or element 120, the output of which is connected with the control circuit of the transistor switch 117. Upon occurrence of coincidence of cabin call $R_C$ and scanner position Ab the transistor switch 117 is controlled so as to be in its non-conductive state, so that at the output of the adder 112 and the output K of the servicing cost computer 72 there are only available for further processing the external servicing costs $K_A$. The internal servicing costs $K_I$ are not taken into account, since the time loss of the passengers located in the elevator cabin can not be ascribed to a storey call which is present for this considered scanner position, rather would arise anyway.

Figure 11:
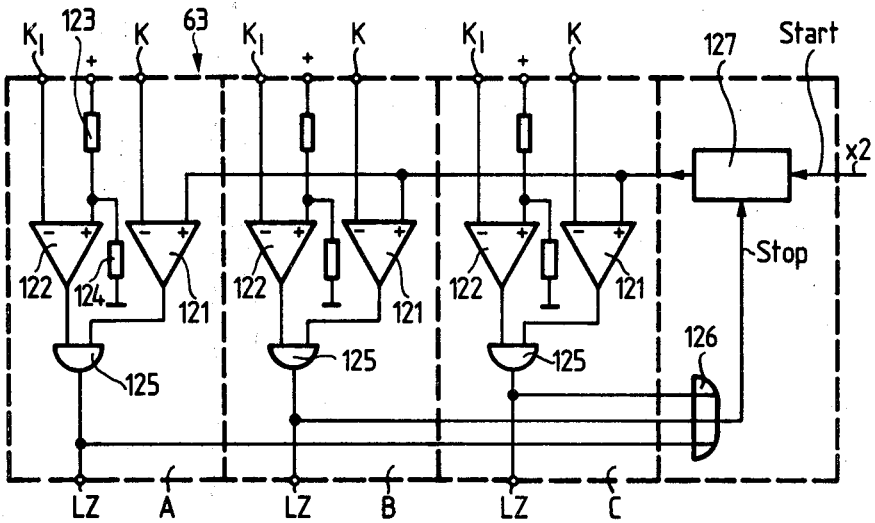
FIG. 11 is a circuit diagram of a comparison device or comparator for an elevator group composed of three elevators.

The exemplary embodiment of comparator or comparison device 63 according to the showing of FIG. 11 comprises, for each elevator cabin A, B and C, two comparators 121, 122 in the form of operational amplifiers, a voltage divider composed of resistances 123, 124, an AND-gate or element 125 having two inputs and conjointly for all elevator cabins an OR-gate or element 126 having three inputs as well as a ramp generator 127 which, for instance, is known from Swiss Pat. No. 463,741, to which reference may be readily had and the disclosure of which is incorporated herein by reference. The non-inverting input of the first comparator 126 is connected with the output of the ramp generator 127, whereas the inverting input is connected with the output K of the servicing cost computer 72 of the related cabin. The non-inverting input of the second comparator 122 is connected by means of the resistance or resistor 123 of the voltage divider 123, 124 with the positive terminal of a voltage source, whereas the inverting input is connected with the output $K_I$ of the servicing cost computer 72 of the related elevator cabin. The outputs of the comparators 121, 122 are connected with the inputs of the AND-gate 125, the output of which is connected in each instance at the related output LZ of the comparator 63 and an input of the OR-gate or element 126. The output of the OR-gate 126 is connected with a stop-terminal of the ramp generator 127, which is connected by means of a start-terminal x2 with the clock generator 66.

Figure 12:
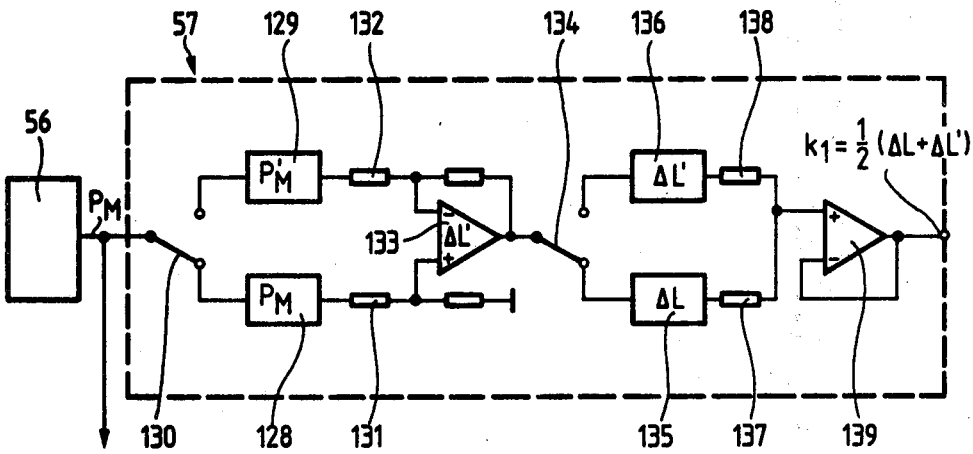
FIG. 12 is a circuit diagram of a load storage of the group control shown in FIG. 6.

In FIG. 12 there have been illustrated by reference characters 128 and 129 analogue storages or memories in the form of sample-and-hold circuits, the inputs of which are alternately connected, by means of the contacts of a reversing switch 130 arranged at the elevator cabin B, with the output PM of the load measuring device 56. This load measuring device 56 is equipped, for instance, with a force measuring can or cell serving as a measuring value transmitter. The outputs of the analogue storages 128 and 129 are connected by means of resistances 131 and 132, respectively, with the inputs of a subtractor or subtracting device 133 in the form of an operational amplifier, the output of which is alternately connected by means of a further reversing switch 134 arranged at the elevator cabin B, with the inputs of two further analogue storages 135, 136 in the form of sample-and-hold circuits. The outputs of the analogue storages 135 and 136 are connected by resistances or resistors 137 and 138, respectively, with an input of an adder or adding device 139 in the form of an operational amplifier connected as a voltage follower, the output of which forms the output $k_1$ of the load storage or memory 57.

The previously described load storage 57 operates as follows:

Shortly prior to stop of the elevator cabin B at a storey of the serviced building or other structure the switch means or reversing switch 130 is activated and the output $P_M$ of the load measuring device 56 is connected with the analogue storage 129, and a cabin load $P_M'$ which is setting during the elevator stop is stored. At the subtracting device or subtractor 133 there is formed from such cabin load $P_M'$ stored in the analogue storage 129 and the cabin load $P_M$ stored in the analogue storage or memory 128 and predicated upon the preceding stop the load difference $\Delta L'$. Since along with the switch means 130 there is also simultaneously actuated the switch means or reversing switch 134 the output of the subtractor 133 is connected with the input of the analogue storage 136 and the load difference $\Delta L'$ is stored thereat. In the adder 139 there is now formed from such load difference $\Delta L'$ and the load difference $\Delta L$ stored in the analogue storage or memory 135 and predicated upon the preceding stop the arithmetic mean $k_1 = \frac{1}{2}(\Delta L + \Delta L')$, wherein the factor $\frac{1}{2}$ is governed by the resistances or resistors 137, 138.

Figure 13:
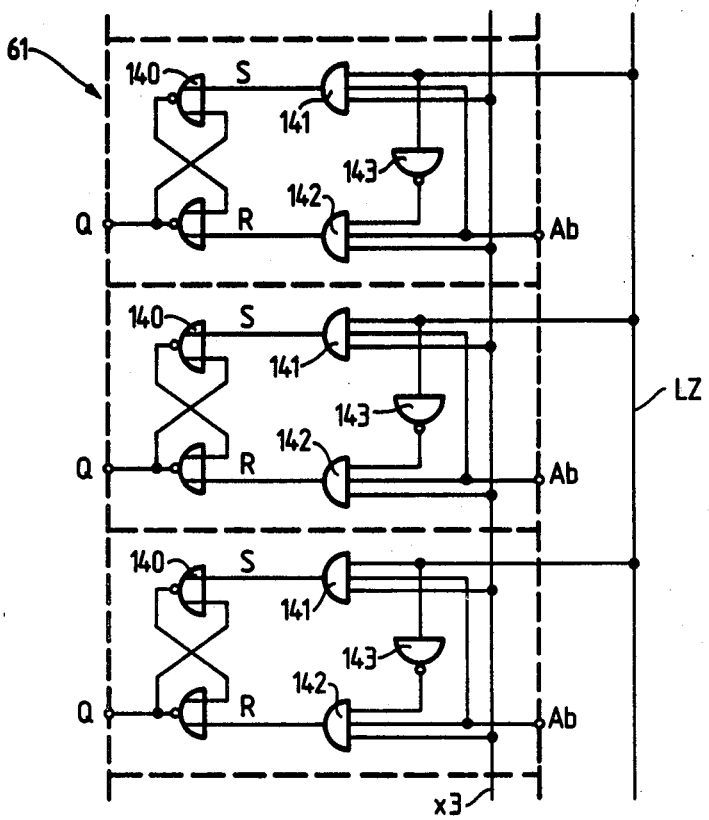
FIG. 13 is a circuit diagram of three storage cells of an allocation storage of the group control illustrated in FIG. 6.

In FIG. 13 reference character 140 designates an RS-flip-flop composed of two NOR-gates or elements of a storage cell of the allocation storage 61. The inputs R, S of the flip-flop 140 are connected with the outputs of two AND-gates 141, 142 each of which possess three respective inputs. The first input of the AND-gates 141, 142 are connected by means of a line x3 with the clock generator 66, whereas the second inputs are connected with the outputs Ab of the scanner 65 correlated to the momentary storage cell. The third inputs of the AND-gates 141, 142 are connected by means of the line LZ with the comparator 63, and the third input of the AND-gate 142, connected at the input R of the flip-flop 140, has connected forwardly thereof a NOT-gate or element 143.

The previously described group control operates in the following manner:

Upon occurrence of the scanner signal Ab=1 of a considered storey or floor and controlled by the first clock signal x1 there are determined at the computers 62 of the elevators cabins A, B and C the servicing costs K and $K_I$ related to the momentary scanner position and such is infed to the comparator device or comparator 63. Upon occurrence of the second clock signal x2 following in time the first clock signal x1, the ramp generator 127 of the comparator 63 is placed into operation. As a result thereof, there is generated an output signal which ascends essentially linearly as a function of time. Now if, for instance, the elevator cabin B possesses the lowest servicing costs K, then initially there is switched the therewith operatively associated comparator 121, and at its output there appears a logic signal "1". If at the same time the internal servicing costs $K_I$ of the elevator cabin B are below a threshold value which is set by means of the voltage divider 123, 124, then also the output of the second comparator 122 carries a logic signal "1". Because of the logic signal "1" subsequently appearing at the output of OR-gate or element 126 the ramp generator 127 is placed out of operation, and the comparison is completed. The logic signal "1" which simultaneously appears at the output LZ correlated to the elevator cabin B is infed to the allocation storage 61 of such elevator cabin B. After completion of the comparison operation there appears the clock signal x3=1 which follows in time the second signal x2, whereafter the storage cell correlated to the considered storey or floor of the allocation storage 61 is set by means of the AND-gate 141 and there appears at the output Q an allocation command or instruction in the form of a logic signal "1". Upon presence of a storey call of the same scanner position it is possible, as already described in detail hereinabove, to initiate at the drive control 51 the stop of the elevator cabin B. However, if the elevator cabin B does not possess the smallest servicing costs K or if its internal servicing costs $K_I$ are greater, because of overload, than the threshold value which has been set at the voltage divider 123, 124, then the comparison is stopped by another elevator cabin. Since in this case there is present the logic signal "0" at the terminal or line LZ, the related storage cell of the allocation storage 61 of the elevator cabin B is not set. However, if it has been set by the preceding comparison, then, it is reset to the logic state "0" by means of the NOT-gate 143 and the AND-gate 142.

While there are shown and described present preferred embodiments of the invention, it is to be distinctly understood that the invention is not limited thereto, but may be otherwise variously embodied and practiced with the scope of the following claims. Accordingly,

What we claim is:

1. In a group control for elevators each having an elevator cabin and containing:

at least one storey call storage controllable by means of a storey call transmitter;

cabin call storages for controlling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey;

and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing costs for the relevant position of the scanner device;

said storage device containing the optimum correlations between the elevator cabin and scanner position contains for each elevator an allocation storage which can be filled during a revolution of the scanner device;

said allocation storage having inputs connected with said comparison device;

comparison of the servicing costs of the elevator cabins occurring at each scanner position; and the elevator cabin exhibiting the lowest servicing costs having stored in the allocation storage an allocation instruction corresponding to the optimum correlation.

2. In a group control for elevators each having an elevator cabin and containing:

at least one storey call storage controllable by means of a storey call transmitter;

cabin call storages for controlling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey;

and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing costs for the relevant position of the scanner device;

the subtractor unit of the computer device having an output;

the adder of the computer device having an input and output;

a switching element for connecting the output of the subtractor unit with the input of the adder;

coincidence circuit means containing an OR-gate and for each scanner position an AND-gate;

said scanner device having outputs;

said OR-gate having inputs and an output;

sand AND-gate having inputs and outputs;

one input of said AND-gate being connected with the related scanner output and another input thereof being capable of having infed thereto a possibly present cabin call;

the outputs of the AND-gates being connected with the inputs of the OR-gate;

said switching element having a control circuit;

the output of the OR-gate being connected with the control circuit of said switching element; and upon occurrence of a coincidence of cabin call and scanner position the output of the subtractor unit is disconnectable from the input of the adder, so that at the adder output there exclusively appears the external servicing costs.

3. In a group control for elevators each having an elevator cabin and containing:

at least one storey call sorage controllable by means of a storey call transmitter;

cabin call storages for controlling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey;

and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing costs for the relevant position of the scanner device;

said computer device possesses a further subtractor unit generating the internal servicing costs; and said further subtractor unit having an output forming an output of said computer device.

4. The group control for elevators as defined in claim 1, wherein:

each elevator cabin is provided with a storey call storage;

each of said storey call storages containing storage cell means having outputs;

said allocation storage having outputs;

and AND-gate having inputs and an output; and the outputs of the storage cells of the storey call storage and the allocation storage being connected with the inputs of said AND-gate, so that upon the presence of an allocation instruction and a storey call with the same scanner position there appears at the output of the AND-gate a storey call which has been allocated to the relevant elevator cabin.

5. In a group control for elevators each having an elevator cabin and containing:

at least one storey call storage controllable by means of a storey call transmitter;

cabin call storages for controlling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey; and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing costs for the relevant position of the scanner device;

the determination of the servicing costs in passenger seconds is accomplished by the computer device for a random cabin of the elevator group during each scanner position in accordance with the following equation:

$$K_{Nn}=t_V(P_M+k_1\cdot R_E-K_2\cdot R_C)+k_1[m\cdot t_m+t_v\cdot(R_E+R_C-R_{EC}+Z)]$$

wherein:

$t_V$ represents the delay time during an intermediate stop, $P_M$ represents the momentary load at the point in time of computation, $R_E$ represents the number of allocated storey calls between the selector and scanner position n, $R_C$ represents the number of cabin calls between the selector and scanner position n, $k_1$ represents a contemplated number, determined as a function of the traffic conditions, of persons entering the cabin per storey call, $k_2$ represents a contemplated number, determined as a function of the traffic conditions, of exiting passengers per cabin call, m represents the number of storey distances between the selector and scanner position n, $t_m$ represents the mean travel time per storey distance, $R_{EC}$ represents the number of coincidences of cabin calls and allocated storey calls between selector and scanner position, Z represents an addition dependent upon the operating state of the cabin, $t_v$ $(P_m+k_1 \cdot R_E-k_2 \cdot R_C)$ represents the loss times of internal servicing costs ($K_I$) corresponding to passengers who apparently will be located in the cabin, which costs can arise during a stop at a storey designated by the scanner position n, and $k_1$ $[m \cdot t_m+t_V(R_E+R_C-R_{EC}+Z)]$ represents the loss times of contemplated waiting passengers in a storey designated by the scanner position n corresponding to the external servicing costs ($K_A$);

said comparison device for each elevator cabin containing two comparators defining a first comparator and a second comparator;

each of said comparators having input means and output means;

said input means of said first comparator being capable of receiving the total servicing costs and a reference signal;

the input means of said second comparator being capable of receiving the internal servicing costs and a threshold signal;

an AND-gate having inputs and an output;

said comparison device having an output;

said output means of said comparators being connected with said inputs of said AND-gate;

the output of said AND-gate being connected with said output of said comparison device; and the output means of said comparators possessing the logic state "1" for that elevator cabin where the total servicing costs are lowest and the internal servicing costs are smaller than the threshold signal.

6. In a group control for elevators each having an elevator cabin and containing:

at least one storey call storage controllable by means of a storey call transmitter;

cabin call storages for contolling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey;

and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing cost for the relevant position of the scanner device;

the storage device containing the optimum correlation of the cabin and scanner position for each elevator contains a cost storage which can be filled during a revolution of a first scanner of the scanner device;

the storage device further containing an allocation storage which can be filled during a revolution of a second scanner of the scanner device;

the servicing costs computated during each scanner position being stored in the cost storages;

in the allocation storages there can be stored the allocation instructions corresponding to the optimum correlations;

a load storage in which there can be stored the cabin load determined in the related load measuring device and the load differences determined during each stop at a storey call;

the contemplated number of entering passengers being determined at each stop at a storey call from the load differences of the momentary and preceding computated arithmetic means $\frac{1}{2}(\Delta L+\Delta L')$;

said load storage comprises two analogue storages;

said analogue storages having inputs and outputs;

each said load measuring device having an output;

switch means for connecting the inputs of said analogue storages alternately with the output of said load measuring device;

a subtractor having inputs and an output;

the outputs of said analogue storages being connected with the inputs of said subtractor;

two further analogue storages having inputs and outputs;

further switch means for alternately connecting the output of the subtractor with the inputs of said two further analogue storages;

an adder having input means and output means;

the outputs of said two further analogue storages being connected with the input means of said adder; and said output means of said adder having appearing thereat a signal which indicates the contemplated number of entering passengers.

7. In a group control for elevators each having an elevator cabin and containing:

at least one storey call storage controllable by means of a storey call transmitter;

cabin call storages for controlling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey;

and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing cost of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing costs for the relevant position of the scanner device;

the determination of the servicing costs in passenger seconds is accomplished by the computer device for a random cabin of the elevator group during each scanner position in accordance with the following equation:

$$K_{Nn}=t_V(P_M+k_1\cdot R_E-K_2\cdot R_C)+k_1 m\cdot t_m+t_v\cdot(R_E+R_C-R_{EC}+Z)]$$

wherein:

$T_V$ represents the delay time during an intermediate stop, $P_M$ represents the momentary load at the point in time of computation, $R_E$ represents the number of allocated storey calls between the selector and scanner position n, $R_C$ represents the number of cabin calls between the selector and scanner position n, $k_1$ represents a contemplated number, determined as a function of the traffic conditions, of persons entering the cabin per storey call, $k_2$ represents a contemplated number, determined as a function of the traffic conditions, of exiting passengers per cabin call, m represents the number of storey distances between the selector and scanner position n, $t_m$ represents the mean travel time per storey distance, $R_{EC}$ represents the number of coincidences of cabin calls and allocated storey calls between selector and scanner position, Z represents an addition dependent upon the operating state of the cabin, $t_v$ $(P_m+k_1\cdot R_E-k_2\cdot R_C)$ represents the loss times of internal servicing costs ($K_1$) corresponding to passengers who apparently will be located in the cabin, which costs can arise during a stop at a storey designated by the scanner position n, and $k_1$ $[m\cdot t_m+t_V(R_E+R_C-R_{EC}+Z)]$ represents the loss times of contemplated waiting passengers in a storey designated by the scanner position n corresponding to the external servicing costs ($K_A$);

the subtractor unit of the computer device having an output;

the adder of the computer device having an input and output;

a switching element for connecting the output of the subtractor unit with the input of the adder;

coincidence circuit means containing an OR-gate and for each scanner position an AND-gate;

said scanner device having outputs;

said OR-gate having inputs and an output;

said AND-gate having inputs and outputs;

one input of said AND-gate being connected with the related scanner output and another input thereof being capable of having infed thereto a possibly present cabin call;

the outputs of the AND-gates being connected with the inputs of the OR-gate;

said switching element having a control circuit;

the output of the OR-gate being connected with the control circuit of said switching element; and upon occurrence of a coincidence of cabin call and scanner position the output of the subtractor unit is disconnectable from the input of the adder, so that at the adder output there exclusively appears the external servicing costs.

8. In a group control for elevators each having an elevator cabin and containing:

at least one storey call storage controllable by means of a storey call transmitter;

cabin call storages for controlling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey;

and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing costs for the relevant position of the scanner device;

the determination of the servicing costs in passenger seconds is accomplished by the computer device for a random cabin of the elevator group during each scanner position in accordance with the following equation:

$$K_{N_n}=t_V(P_M+k_1\cdot R_E-K_2\cdot R_C)+k_1[m\cdot t_m+t_v\cdot(R_E+R_C-R_{EC}+Z)]$$

wherein:

$t_V$ represents the delay time during an intermediate stop, $P_M$ represents the momentary load at the point in time of computation, $R_E$ represents the number of allocated storey calls between the selector and scanner position n, $R_C$ represents the number of cabin calls between the selector and scanner position n, $k_1$ represents a contemplated number, determined as a function of the traffic conditions, of persons entering the cabin per storey call, $k_2$ represents a contemplated number, determined as a function of the traffic conditions, of exiting passengers per cabin call, m represents the number of storey distances between the selector and scanner position n, $t_m$ represents the mean travel time per storey distance, $R_{EC}$ represents the number of coincidences of cabin calls and allocated storey calls between selector and scanner position, Z represents an addition dependent upon the operating state of the cabin, $t_v$ $(P_m+k_1\cdot R_E-k_2\cdot R_C)$ represents the loss times of internal servicing costs ($K_1$) corresponding to passengers who apparently will be located in the cabin, which costs can arise during a stop at a storey designated by the scanner position n, and $k_1$ $[m\cdot t_m+t_V(R_E+R_C-R_{EC}+Z)]$ represents the loss times of contemplated waiting passengers in a storey designated by the scanner position n corresponding to the external servicing costs ($K_A$);

said computer device possesses a further subtractor unit generating the internal servicing costs; and said further subtractor unit having an output forming an output of said computer device.

9. In a group control for elevators each having an elevator cabin and containing:

at least one storey call storage controllable by means of a storey call transmitter;

cabin call storages for controlling by means of cabin call transmitters each cabin of the group;

selectors operatively correlated with each elevator of the group indicating that storey at which the cabin still could stop;

load measuring devices operatively correlated with each elevator cabin;

a scanner device having at least one position for each storey;

each elevator being provided with a computer device possessing at least one adder which forms from at least the distance between a considered storey and the selector position, from the number of intermediate stops to be expected within such distance based upon the prevailing cabin and allocated storey calls and from the momentary cabin load, a time-proportional sum corresponding to the servicing capability of a cabin of the group with respect to the considered storey;

and at least one comparison device by means of which the cabin having the lowest servicing costs corresponding to the smallest previously computated loss time and therefore the optimum servicing capability can be allocated to the considered storey;

the improvement which comprises:

each elevator being provided with a computer device for counting the number of allocated storey calls and one of a number of cabin calls between a selector position and the considered storey;

each elevator further being provided with a device which stores the momentary operating state of the elevator cabins;

the computer device being provided with a subtractor unit for forming a difference from the number of said allocated storey calls multiplied by a number of passengers expected to enter the elevator cabin and the number of cabin calls multiplied by a number of passengers expected to exit from the elevator cabin;

said difference and a momentary operating state of the elevator cabin being infeedable as a further summand to the adder of the computer device;

the scanner device being connected with the computer device which for each position of the scanner device forms the sum corresponding to the servicing costs of a cabin with respect to a real or imaginary storey call of such position;

a storage device connected with the computer device and the scanner device;

said storage device can be filled by means of said scanner device;

said storage device receiving the correlations of the momentarily most optimumly employable cabin having the lowest servicing costs for the relevant position of the scanner device;

said storage device containing the optimum correlations between the elevator cabin and scanner position contains for each elevator an allocation storage which can be filled during a revolution of the scanner device;

said allocation storage having inputs connected with said comparison device;

comparison of the servicing costs of the elevator cabins occurring at each scanner position;

the elevator cabin exhibiting the lowest servicing costs having stored in the allocation storage an allocation instruction corresponding to the optimum correlation;

said comparison device for each elevator cabin containing two comparators defining a first comparator and a second comparator;

each of said comparators having input means and output means;

said input means of said first comparator being capable of receiving the total servicing costs and a reference signal;

the input means of said second comparator being capable of receiving the internal servicing costs and a threshold signal;

an AND-gate having inputs and an output;

said comparison device having an output;

said output means of said comparators being connected with said inputs of said AND-gate;

the output of said AND-gate being connected with said output of said comparison device; and the output means of said comparators possessing the logic state "1" for that elevator where the total servicing costs are lowest and the internal servicing costs are smaller than the threshold signal.

* * * * *